US005791079A

United States Patent [19]

Mazzucchelli

[11] Patent Number: 5,791,079

[45] Date of Patent: Aug. 11, 1998

[54] MULTI-PURPOSE TAG FOR IRREVERSIBLE FIXING TO OBJECTS DISPLAYED FOR SALE

[75] Inventor: Corrado Mazzucchelli, Grumello Del Monte, Italy

[73] Assignee: Plasti-Max S.p.A., Grumello Del Monte, Italy

[21] Appl. No.: 734,868

[22] Filed: Oct. 22, 1996

[30] Foreign Application Priority Data

Nov. 3, 1995 [IT] Italy ..... GB95A0044

[51] Int. Cl.[6] ..... G09F 3/02

[52] U.S. Cl. ..... 40/625; 40/665; 27/57.1

[58] Field of Search ..... 40/27, 625, 642.01, 40/642.02, 665, 299.01; 292/307 A, 309, 318, 319, 320, 321, 325; 70/57.1, 50

[56] References Cited

U.S. PATENT DOCUMENTS

| | | | |
|---|---|---|---|
| 1,472,381 | 10/1923 | Bangs | 40/27 X |
| 4,646,452 | 3/1987 | Mazzucchelli | 40/299 |
| 4,676,535 | 6/1987 | Mautner | 292/321 X |
| 5,120,097 | 6/1992 | Fattori et al. | 292/318 |
| 5,437,172 | 8/1995 | Lamy et al. | 70/57.1 |

FOREIGN PATENT DOCUMENTS

| | | | |
|---|---|---|---|
| 415651 | 10/1946 | Italy | 292/318 |
| 774054 | 5/1957 | United Kingdom | 40/665 |

*Primary Examiner*—Brian K. Green
*Attorney, Agent, or Firm*—Steinberg & Raskin, P.C.

[57] ABSTRACT

A multi-purpose tag for irreversible fixing to objects displayed for sale including a body having abutments and a through cavity with a rectangular cross-section, a retention structure arranged in the cavity and having projections cooperating with the abutments of the body such that movement of the retention structure out of the cavity is prevented. The retention structure has first and second opposed portions and a pawl arranged on one or both of the first and second portions. The body also includes an elongate strip having teeth along its edges and arranged to slide into the cavity such that the pawl(s) engages teeth on a respective edge of the aid strip and prevents removal of the strip from the cavity once the pawl(s) engages the teeth on the respective edge of the strip. The retention structure also includes a crosspiece extending between the first and second portions to provide rigidity to the retention structure when intact and to enable removable of the strip from the cavity when broken.

14 Claims, 10 Drawing Sheets

MULTI-PURPOSE TAG FOR IRREVERSIBLE FIXING TO OBJECTS DISPLAYED FOR SALE

FIELD OF THE INVENTION

This invention relates to a multi-purpose tag for irreversible fixing to the product, and a tool enabling it to perform an anti-shoplifting function.

BACKGROUND OF THE INVENTION

As is well known, shops of the large-scale distribution type display a plurality of products for sale. These products are exposed to shoplifting to the extent to which the customer has direct access to them in order to hold them for observation. To prevent such theft, said products are associated with generally magnetic warning devices which enable electronic instruments positioned in proximity to the shop exits to detect them and activate alarms. The alarm occurs if the device has not been previously deactivated by appropriate apparatus during payment, or has not been materially removed by the cashier by a specific tool. In all these cases it is a fundamental requirement that the device be efficiently fixed to the product to be protected, such as to resist attempts by shoplifters to remove it from the product. Other very important characteristics required of said devices are: the ability to be fixed to the product without damaging it, low cost, considerable versatility making it suitable for products of many types, and the availability of spaces for attaching labels giving the price or other information generally accompanying the product. Known currently used devices do not completely satisfy these requirements, and in particular are unable properly to economically support price labels or act as hooks for displaying the product by hanging.

OBJECTS AND SUMMARY OF THE INVENTION

An object of the present invention is to define a support tag for labels indicating the product price and other properties which can be irreversibly fixed to the product.

A further object is to define a tag as heretofore, which can resist separation attempts without specific tools.

A further object is to define a tag as heretofore, which can perform an anti-shoplifting function.

A further object is to define tools for the said separation which are of simple use and are economical.

These and further objects will be seen to be attained on reading the following detailed description of a tag for irreversible fixing to the product, characterised by being able to perform a plurality of functions by simple modifications to its structure, said tag being released by means of a specific tool for breaking a pawl when used for anti-shoplifting purposes, and by breaking the strip by which it is fixed to the object when used as a suspension means and a support for price labels.

BRIEF DESCRIPTION OF THE DRAWINGS

The invention is illustrated by way of non-limiting example on the accompanying drawings, in which.

DETAILED DESCRIPTION OF THE PREFERRED EMBODIMENTS

Figure 1:
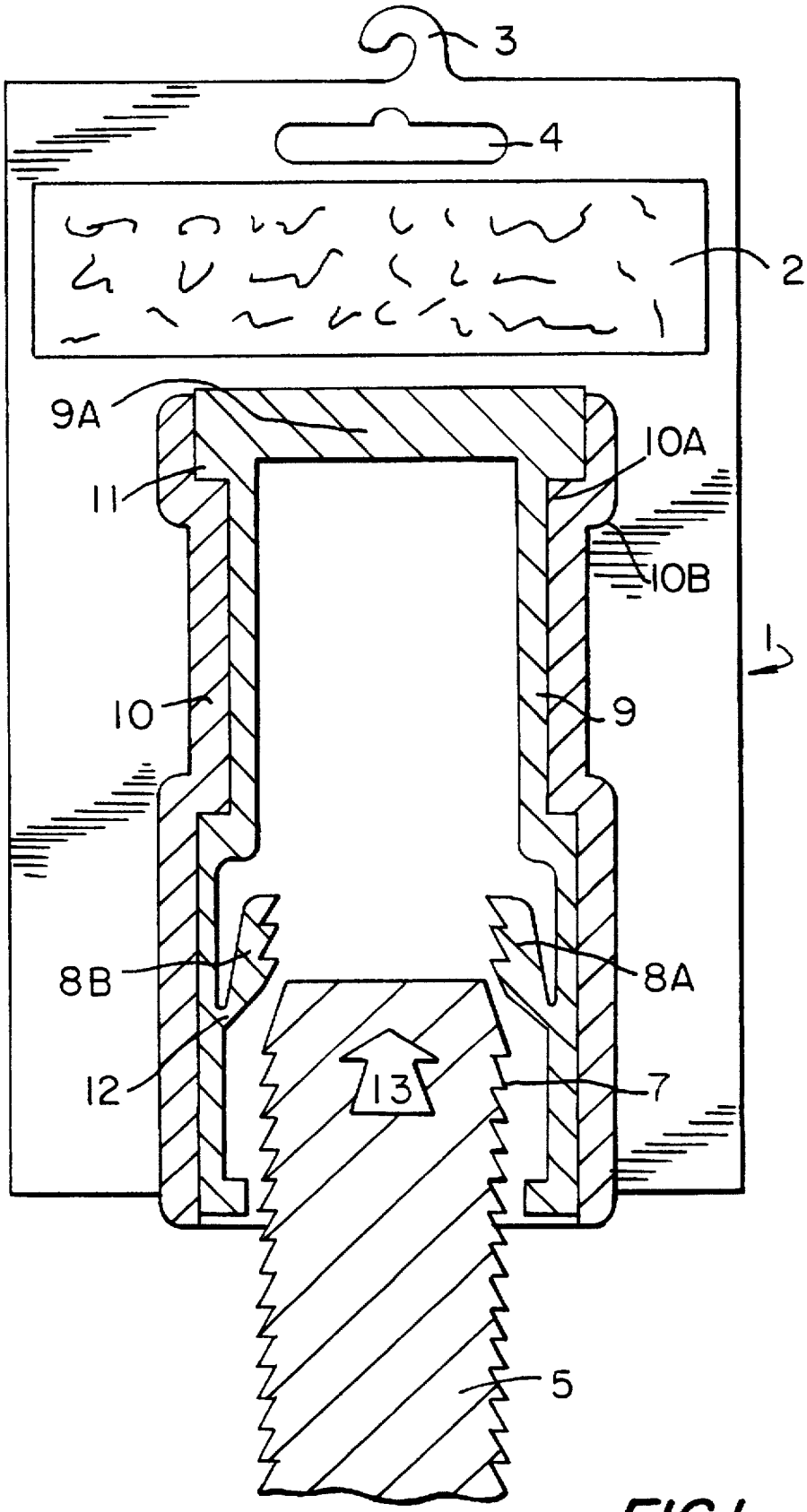
FIG. 1 is a section through a tag associated with an inner rectangular open structure with its two pawls not engaging a toothed strip, which is insufficiently inserted therefor.
Figure 2:
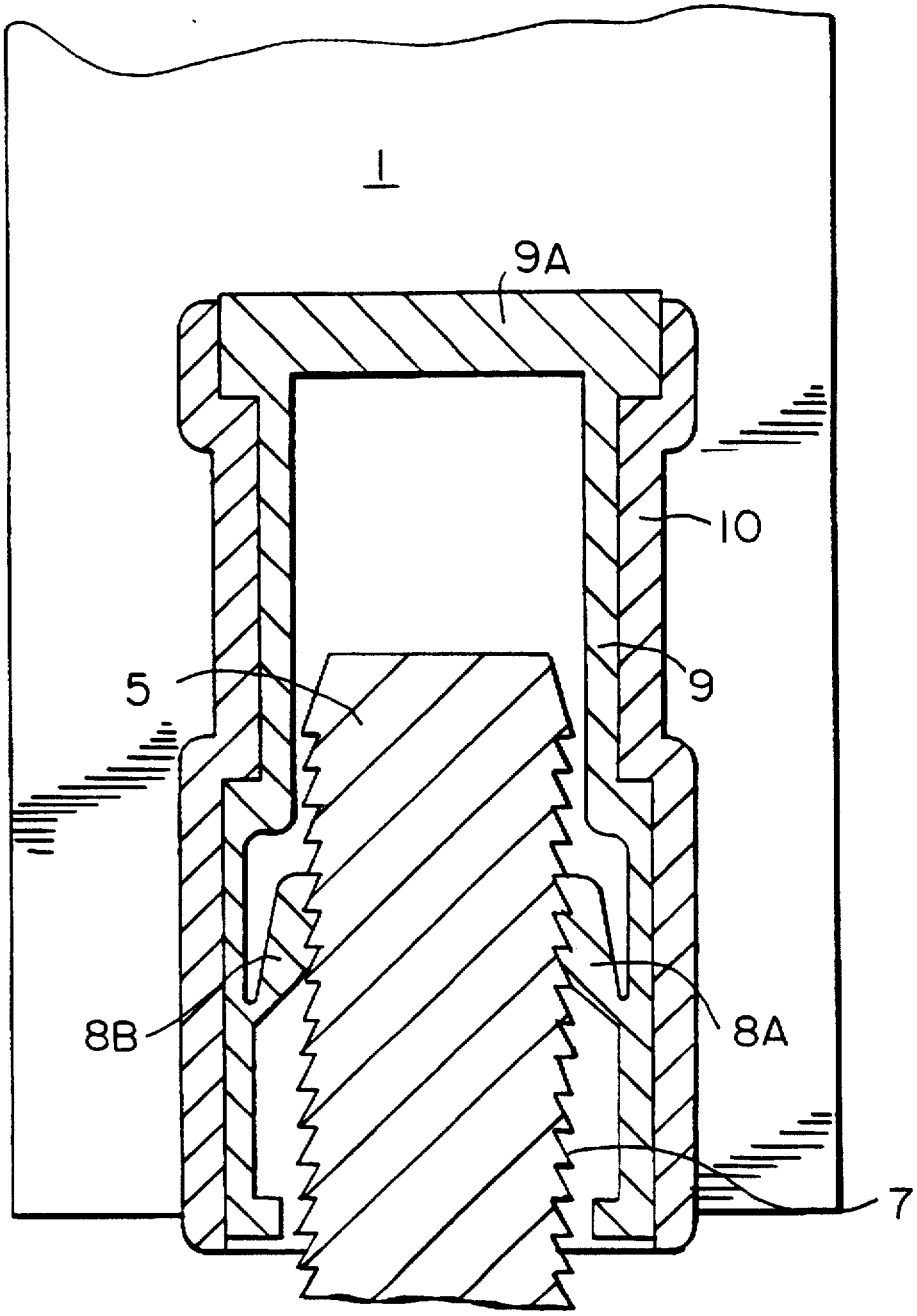
FIG. 2 is the same as the aforegoing figure but with the toothed strip sufficiently inserted to engage the two lateral pawls.

With reference to said FIG. 1, a tag 1 is provided with a usual hook 3 or hole 4 for displaying a generic product P by hanging. The tag 1 also presents surfaces 2 for carrying distinctive product trademarks or labels displaying price or publicity wording.

To perform these functions said tag must comprise means for fixing to the product to be accompanied or supported hanging from appropriate grips on the display shelving of the shop.

Figure 8:
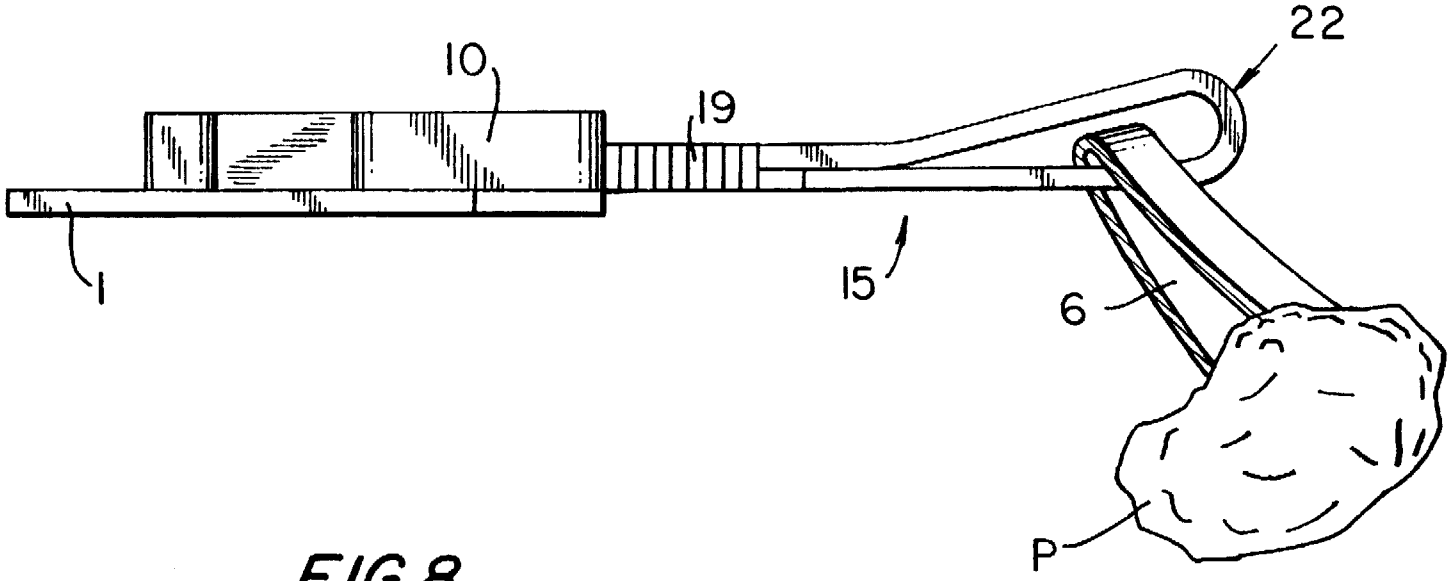
FIG. 8 shows a tag associated with a toothed strip folded to form a loop for fixing to a grip on a generic product.

These means consist of a toothed strip 5 of soft-flexible plastics (for example polyethylene, polypropylene) which is passed through loops 6 (FIG. 8) of a product P or is tightened about its minimum diameter by being folded to U-shape (FIG. 8), after which its toothing 7 is engaged with irreversible retention pawls 8A, 8B provided on a retention structure 9 rigid with the tag 1. The retention structure 9, comprising a crosspiece 9A giving it rigidity, is housed within a body 10 having walls which define a through cavity of rectangular cross-section and provided with abutments 10A cooperating with projections 11 on the retention structure 9. The pawls 8A, 8B are formed by moulding together with the retention structure i.e., there are integral with one another. They are shaped to present a connecting region 12 with minimum resistance to bending but sufficient resistance to compression.

In this manner said region provides them with an articulation or hinge point by which they can elastically approach the strip toothing 7 after withdrawing from it during its insertion 13. The automatic elastic approach of the pawl teeth to the strip toothing results in their engagement and hence the retention of the strip, in that they cannot slip by virtue of being joined to the structure 9 by the region 12.

As however this region is eccentric to the line of action of the forces acting on the teeth, a moment arises which favours the maintaining of said engagement.

The aforegoing defines a tag which can be fixed to general products and hookable to their grips to display them together with information applied to the surface 2 by labels etc, namely a tag acting as a guarantee seal that the product has not been used, as is provided by tags or seals in general.

Hence one of the stated objects of the invention is attained, by the particular construction illustrated.

The aforedescribed version is not however suitable for performing an anti-shoplifting role, in that if a warning device were fixed, as usual, to the surface of the tag 1, a thief could neutralize it by simply cutting the toothed strip 5 and removing the product P. He would then leave the shop with the product suitably concealed and with the warning tag left behind in the shop.

The invention can in this case perform an anti-shoplifting role only to the extent to which the toothed strip 5 cannot be cut by tools of justified possession. In this respect, it is obvious that it would be embarrassing for a thief to justify the possession in his pocket, for example, of shears suitable for cutting through metal parts of some strength.

For this purpose, the invention attains said further object by shaping the soft-flexible plastic strip 5 in such a manner as to be irreversibly combined with a blade 14 of high-strength steel.

Figure 5:
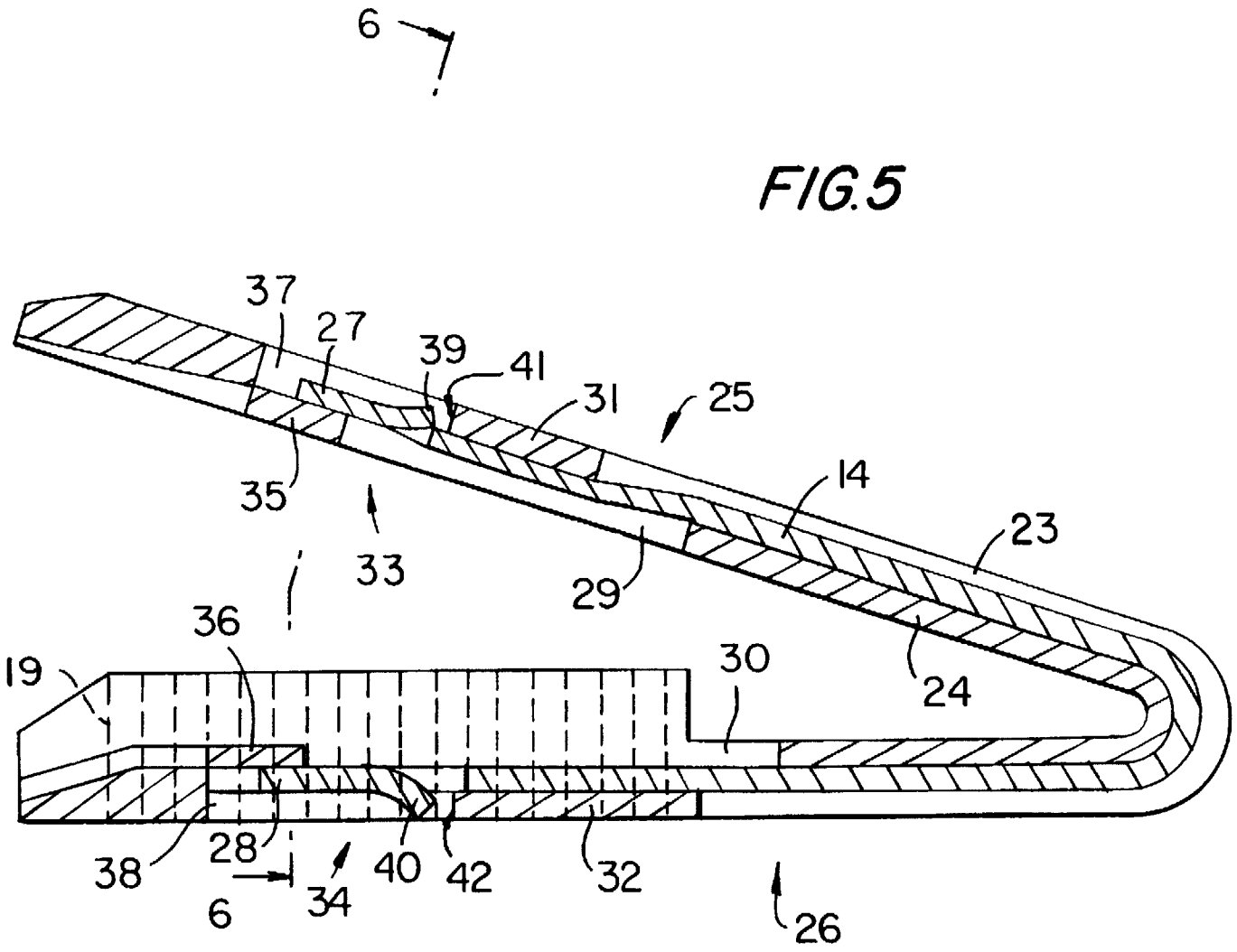
FIG. 5 shows an example of a toothed strip folded in half and strengthened by a laminar steel insert.
Figure 6:
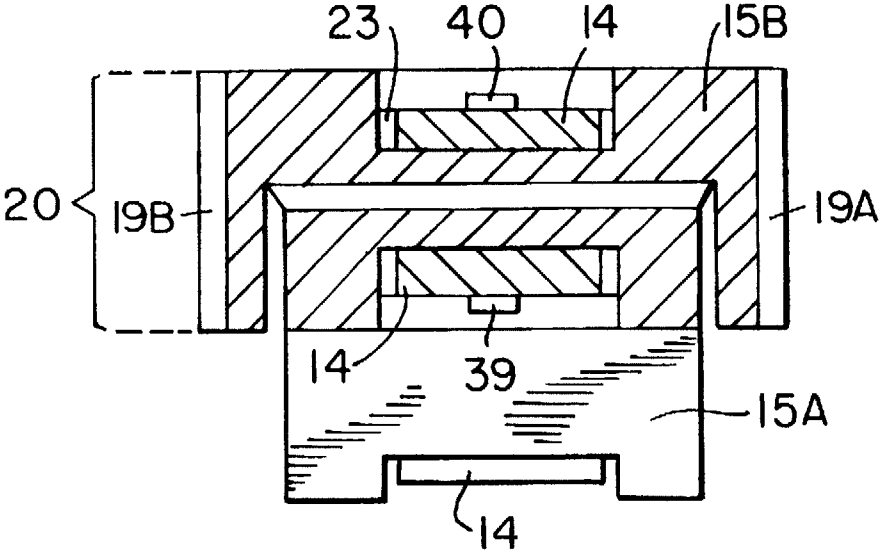
FIG. 6 is a cross-section on the line 6—6 of FIG. 5 showing the strip of FIG. 5 folded into the closed state.
Figure 7:
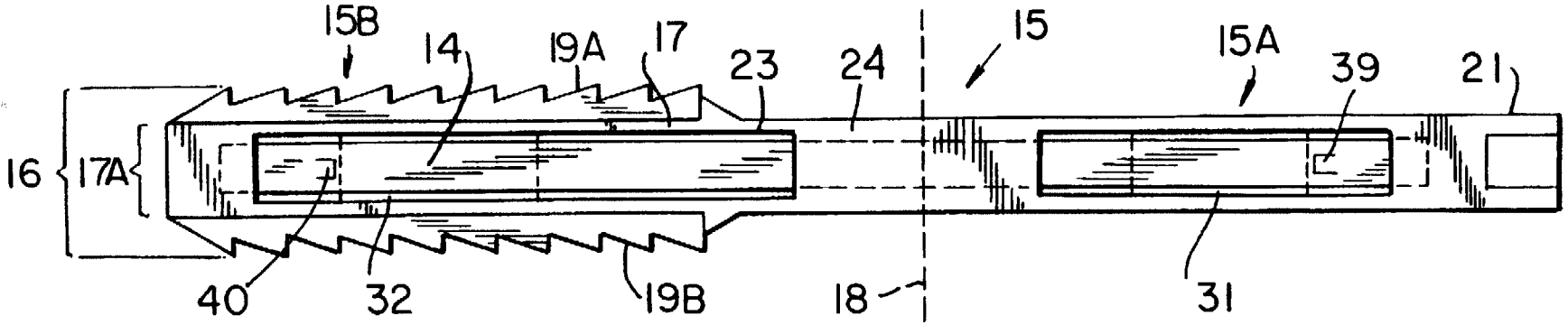
FIG. 7 shows a strip similar to that of FIGS. 5 and 6 but extended and showing its inner side with reference to its folding.

One example of this combination is shown in said FIGS. 5, 6, 7. With reference to FIG. 7, a strip 15 is shown extended on a surface.

This configuration shows a narrow portion 15A extending for about half the total length, and a further portion 15B, extending for the rest of the total length and having a greater width 16. The portion 15B comprises a groove 17 of width 17A for housing the portion 15A when it has been U-folded about a center region 18, as can be seen from the cross-sectional view of FIG. 6. Toothings 19A, 19B are provided on the portion 15B along the two edges of the strip. These toothings have a width 20 which is practically double the thickness of the strip 15, as can be seen from FIG. 8.

The width 20 is intended to engage an equal width of the two pawls 8A and 8B. Although theoretically the portion 15A is not retained by the pawl, it in fact cannot be slidingly extracted from its seating in the groove 17 because of the folding, in progressively different regions and with a small radius 22 (FIG. 8), hindered by the flexural rigidity of the strip.

In this respect, this flexural rigidity is considerable because of the presence of the blade 14 of high-strength steel.

Figure 9:
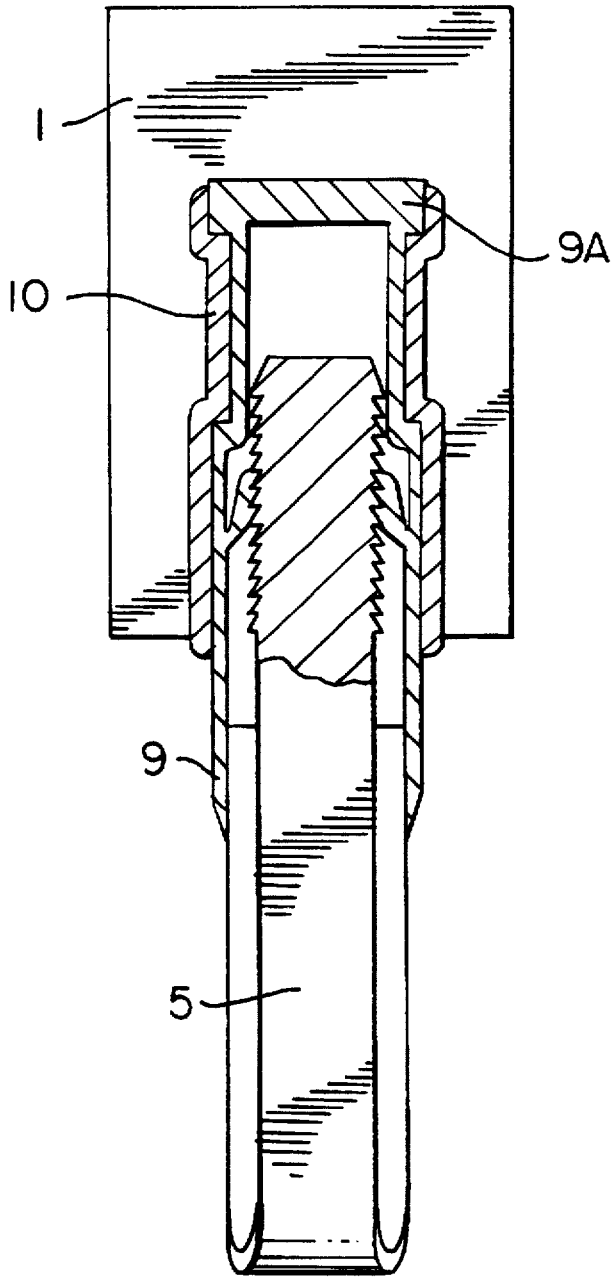
FIG. 9 is a part-sectional view of a tag to which there is fixed a rectangular frame-like structure integral with the loop-foldable toothed strip for fixing to said structure of which it forms part.

This problem would not exist if one end 21 of the portion 15A were integrated into the retention structure 9, inclusive of the pawls 8A, 8B, to form a single body by injection moulding. This is shown in FIG. 9.

The strip can be combined with said steel blade reinforcement either in the manner described hereinafter as a purpose-designed strip, or by its embedding into the plastic during the construction process. This latter method can be effected by known techniques.

Instead, the definition of said first method has involved the solution to various problems with the aim of achieving maximum economy reconciled with maximum efficiency.

From FIGS. 5, 6, 7, it can be seen that the blade 14 rests on the base 24 of a suitable groove 23 provided in the intermediate region of the strip.

The length of this base is limited by the presence of two square holes 25 and 26, provided to enable the ends 27 and 28 of the blade 14 to penetrate to the base 31 and 32 of grooves 29 and 30 provided in the other face of the strip.

From these positions, the ends 27 and 28 of the blade penetrate through other respective square holes 33 and 34 and again pass to that side of the strip on which the groove 23 is present. They then rest on respective bases 35 and 36 of grooves 37 and 38. The bases 35-36, 31-32, 24 are at a level such that in order to rest on them, the blade must follow a sinuous path, ie undergo inflections which facilitate stabilization of its location. The basic fixing is however determined by teeth 39 and 40, formed by U-cuts in the blade 14, and engaged against edges 41 and 42 respectively. In this manner, slippage between the steel blade and the plastic strip in which it is housed is prevented in both directions.

Advantageously, these arrangements in the form of plastic strips with a metal core allow cooperation with plastic pawls and handling via non-cutting materials such as the plastic material with which the strip is constructed.

This does not mean that the strip cannot be formed simply as a foldable metal blade toothed at its ends with toothing which can be superposed on and engaged with the plastic pawls.

Figure 10:
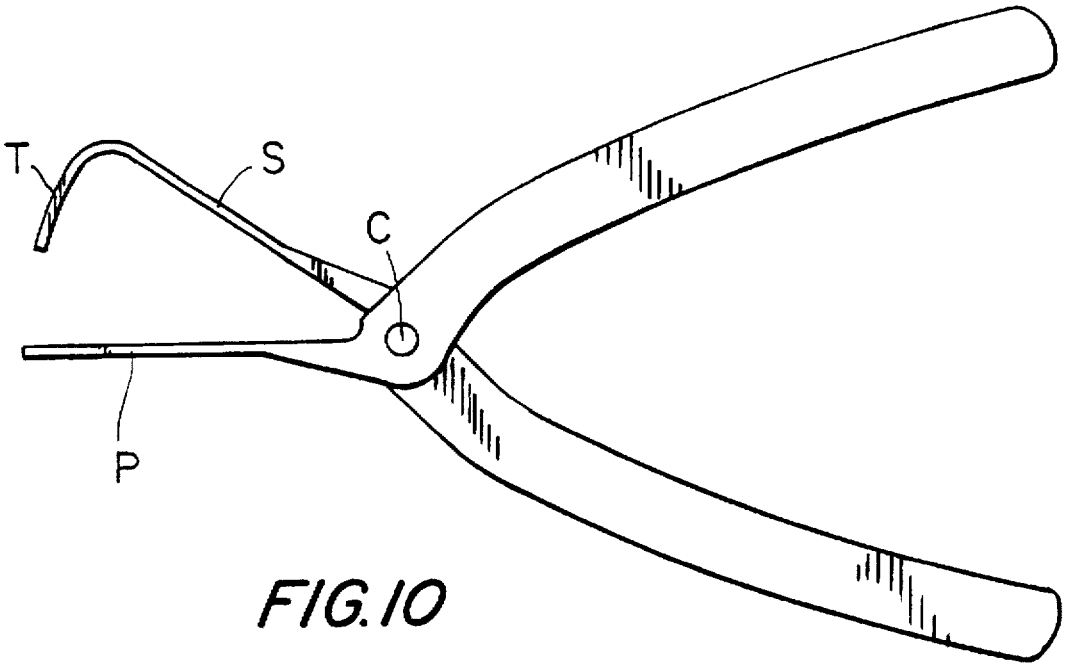
FIGS. 10, 11, 12, 13 show a tool together with its operation in cooperation with the tag.
Figure 11:
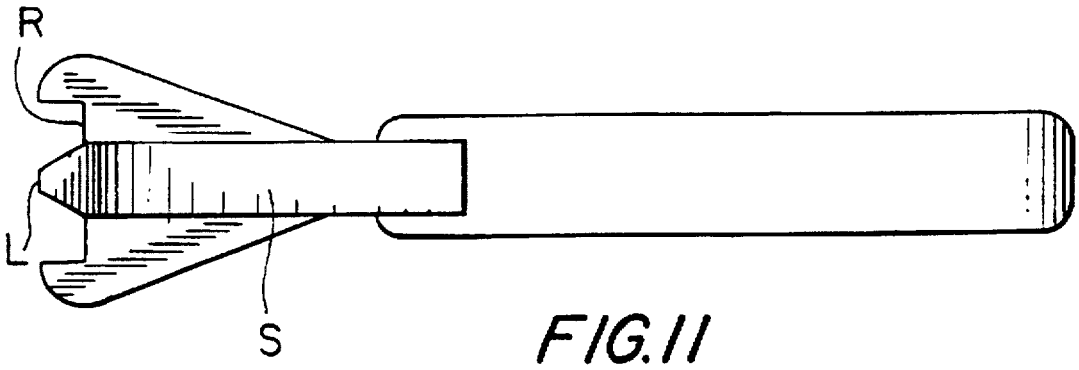

FIGS. 10 and 11 show two views of a tool of pliers shape suitable for breaking the crosspiece 9A by bending it.

Figure 12:
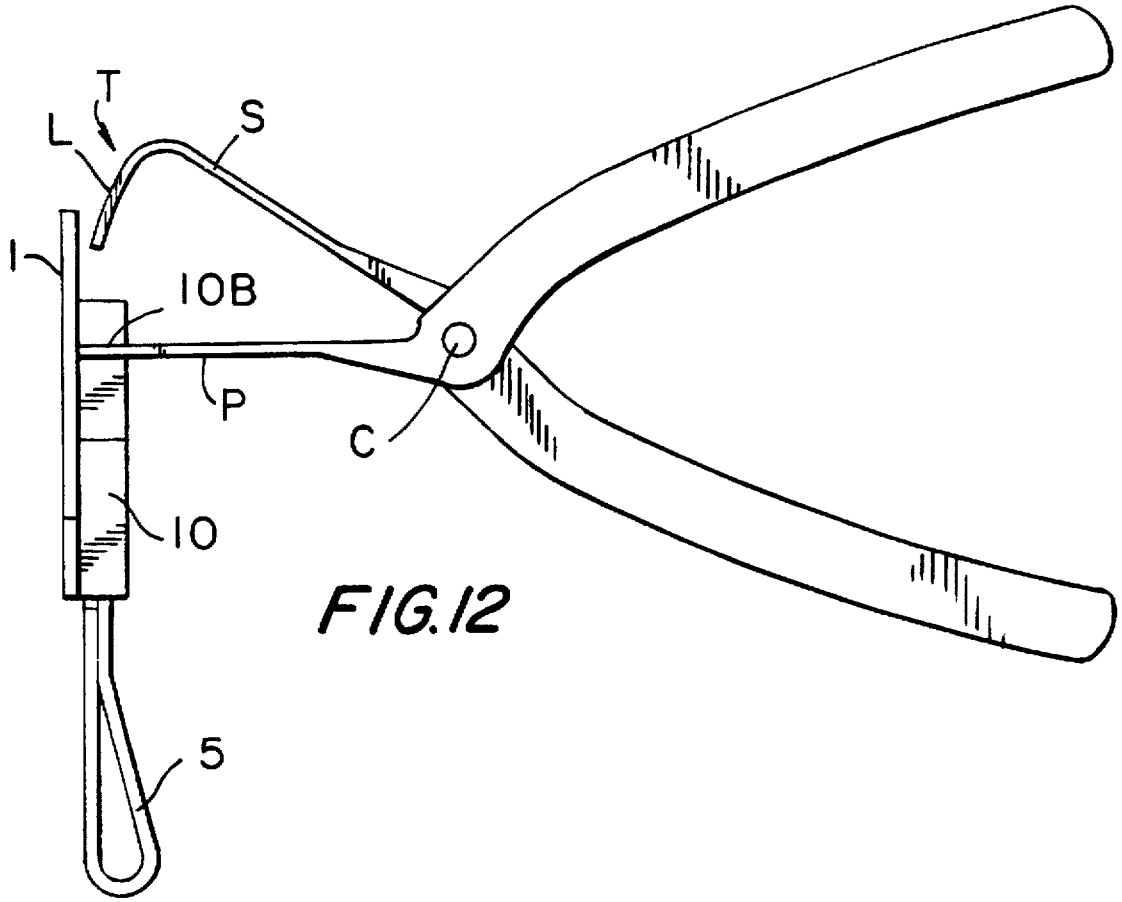
Figure 13:
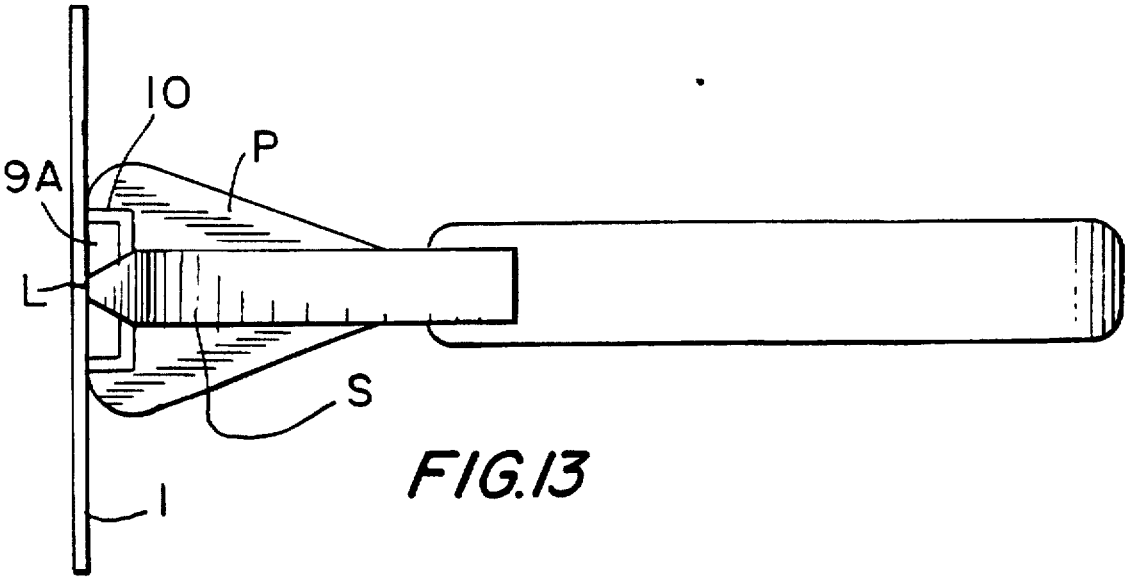

FIGS. 12 and 13 show the method of operation of this tool. Said tool, indicatively of steel, is of pliers type comprising a usual spring for returning it to its open state, one of the two biting ends consisting of a flat radial plate P comprising a rectangular recess R for jointly housing the body 10 containing the through cavity in the tag, and for supporting it by its lateral projections 10B.

Figure 3:
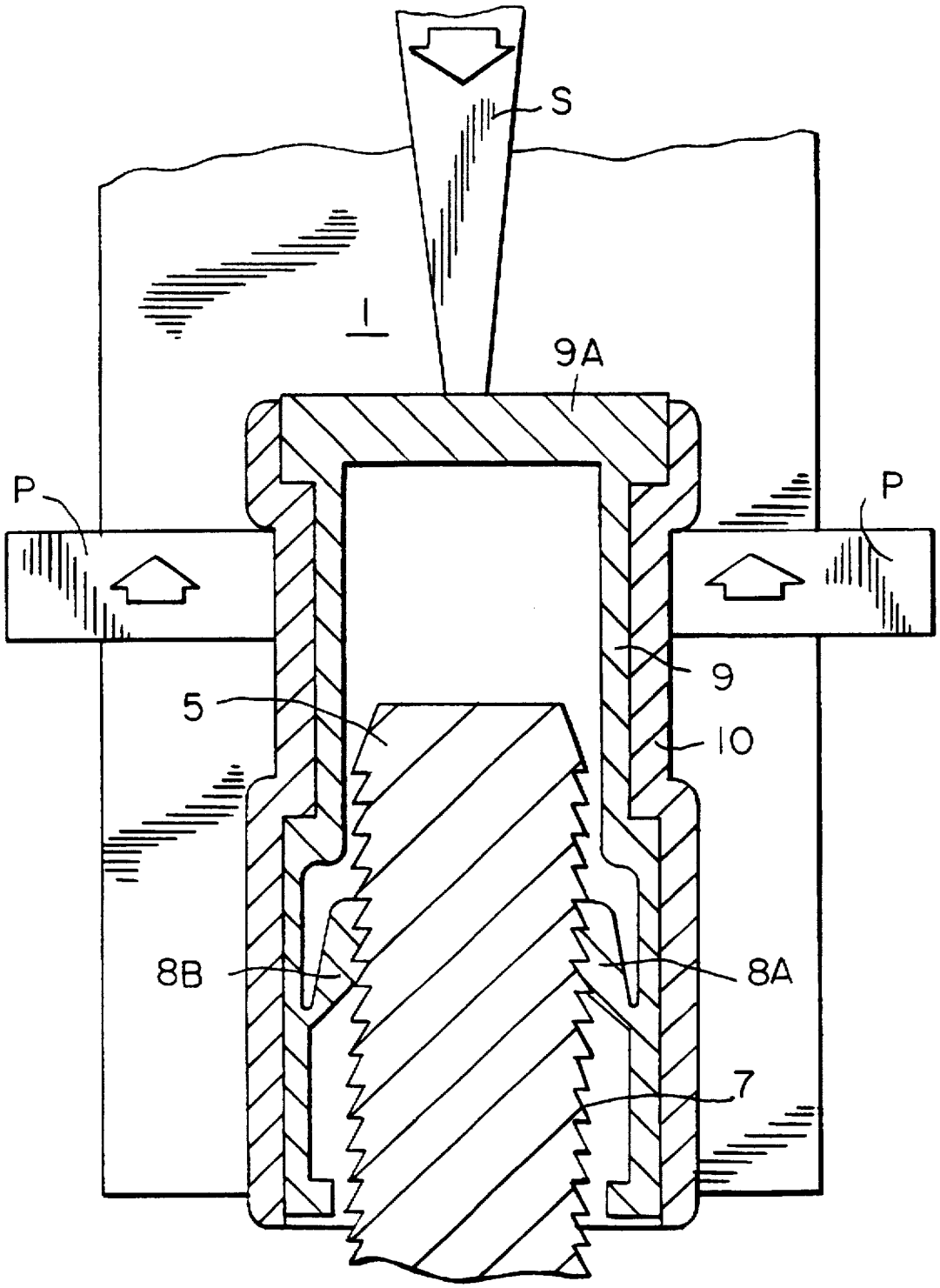
FIG. 3 repeats FIG. 2 to which there are applied two parts of appropriate pliers used to break a crosspiece of the structure by being forced together.
Figure 4:
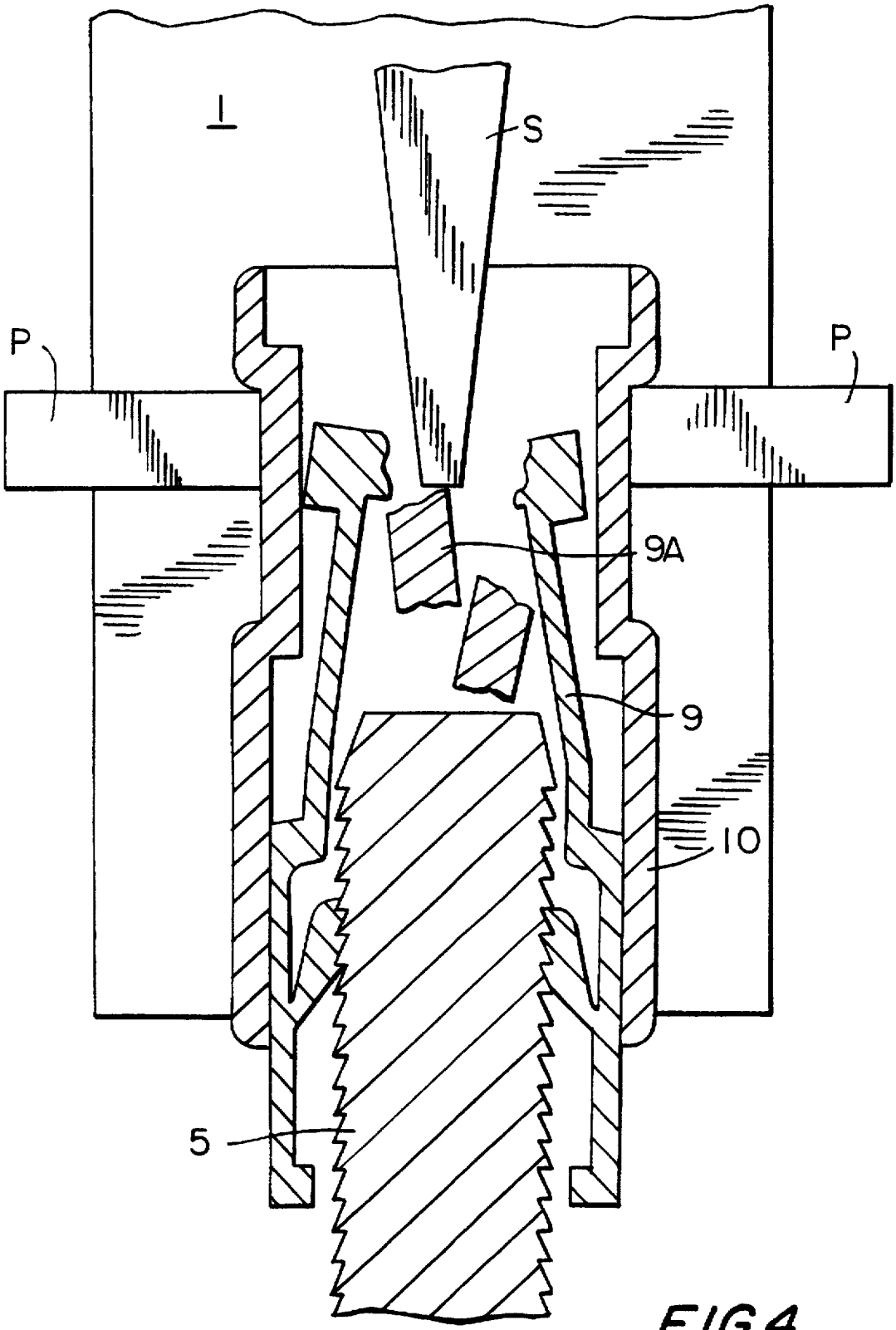
FIG. 4 shows how, following the breakage of the crosspiece, the structure of which it formed part and comprising the two pawls no longer provides these latter with the necessary restraint, so enabling the toothed strip to be withdrawn.

Said pliers have their other biting end S of beak shape T with an arched surface concentric with the pivotal centre C of the pliers. Said end S has a small width so that it can penetrate the through cavity of rectangular cross-section in the body 10 of the tag 1, to the extent of breaking the crosspiece 9A of the retention structure 9 by bending it (FIGS. 3, 4).

I claim:

1. A multi-purpose tag adapted to be fixed to objects displayed for sale, comprising:

a body including walls defining a through cavity and having abutments, a retention structure arranged in said cavity and having projections cooperating with said abutments of said body to prevent movement of said retention structure out of said cavity, said retention structure including first and second opposed portions spaced apart from one another and at least one pawl arranged on a respective one of said first and second portions, each of said first and second portions being arranged adjacent one of said walls defining said cavity, and an elongate strip having teeth along its edges, said strip sliding into said cavity such that said at least one pawl engages the teeth on a respective edge of said strip and prevents removal of said strip from said cavity once said at least one pawl engages the teeth on the respective edge of said strip, said retention structure further comprising a crosspiece extending between said first and second portions to provide rigidity to said retention structure when intact and to enable removal of said strip from said cavity when broken.

2. The tag of claim 1, wherein said crosspiece is made of a rigid, breakable material, said projections of said retention structure being arranged in engagement with said abutments of said body when said crosspiece is intact and when said crosspiece is broken, said projections being removable from engagement with said abutments to allow removal of said strip and said at least one pawl from said cavity.

3. The tag of claim 1, wherein said strip is elongate and the teeth on said strip extending in a direction perpendicular to a longitudinal direction of said strip, said strip being made of a material which prevents its breakage.

4. The tag of claim 1, wherein said strip is made of a plastic material and includes a blade made of high-strength steel embedded into said plastic material.

5. The tag of claim 1, wherein said strip is elongate and has teeth along its edges at each end, said teeth at both ends engaging with said at least one pawl upon insertion of said strip into said cavity.

6. The tag of claim 1, wherein said strip is elongate, has teeth along its edges and is formed of soft plastic, said strip includes grooves at each end, further comprising an elongate metal blade arranged in said strip and having ends situated in a respective one of said grooves such that said ends of said metal blade do not project beyond a periphery of said strip, said metal blade including a projection arranged at each end on a flat side of said metal blade, each of said projections engaging with an edge of said strip defining a respective one of said grooves to thereby longitudinally lock said metal blade in connection with said strip.

7. The tag of claim 1, wherein said strip has a first portion and a second portion including a groove having a width larger than a width of said first portion such that said groove is structured and arranged to receive said first portion upon bending of said strip, said second portion having teeth along its edges extending along substantially the width of said second portion.

8. The tag of claim 1, wherein said walls are arranged such that said through cavity has a substantially rectangular cross-section.

9. The tag of claim 1, wherein said at least one pawl and said crosspiece are integral with one another.

10. The tag of claim 1, wherein said at least one pawl, said first and second portions of said retention structure and said crosspiece are integral with one anther.

11. The tag of claim 1, wherein said at least one pawl comprises first and second pawls, said first pawl being arranged on said first portion and said second pawl being arranged on said second portion in opposed relationship to said first pawl.

12. The tag of claim 1, wherein said strip and said retention structure are integrated into one another such that a single elongate body is formed.

13. The tag of claim 1, further comprising an elongate rigid member arranged in connection with said strip.

14. The tag of claim 13, wherein said strip includes retaining means for retaining said rigid member, said retaining means comprising holes and a groove arranged at each end of said strip, each end of said rigid member being arranged to pass through said holes and said groove at a respective end of said strip.

* * * * *

UNITED STATES PATENT AND TRADEMARK OFFICE

CERTIFICATE OF CORRECTION

PATENT NO. : 5,791,079

DATED : August 11, 1998

INVENTOR(S) : Corrado MAZZUCCHELLI

It is certified that error appears in the above-identified patent and that said Letters Patent is hereby corrected as shown below:

On the cover page, at item [30] under "Foreign Application Priority Data", change "GB95A0044" to --BG 95 A 0044--.

Signed and Sealed this

Fifth Day of January, 1999

*Attest:*

*Attesting Officer*

*Acting Commissioner of Patents and Trademarks*